US005908212A

United States Patent [19]

Smith et al.

[11] Patent Number: 5,908,212

[45] Date of Patent: Jun. 1, 1999

[54] ULTRA HIGH TORQUE DOUBLE SHOULDER TOOL JOINT

[75] Inventors: Jackie E. Smith, Houston; Thomas E. Winship, College Station; Gerald E. Wilson, Montgomery, all of Tex.

[73] Assignee: Grant Prideco, Inc., The Woodlands, Tex.

[21] Appl. No.: 08/850,658

[22] Filed: May 2, 1997

[51] Int. Cl.[6] ..... F16L 25/00

[52] U.S. Cl. ..... 285/333; 285/355; 285/390

[58] Field of Search ..... 285/333, 334, 285/355, 390; 403/343

[56] References Cited

U.S. PATENT DOCUMENTS

| | | | |
|---|---|---|---|
| 2,532,632 | 12/1950 | MacArthur | 285/333 X |
| 3,079,181 | 2/1963 | Van Der Wissel | 285/333 |
| 4,521,042 | 6/1985 | Blackburn et al. | 285/334 |
| 4,548,431 | 10/1985 | Hall et al. | 285/334 |
| 4,549,754 | 10/1985 | Sanders et al. | 285/334 |
| 5,358,289 | 10/1994 | Banker et al. | 285/334 |
| 5,492,375 | 2/1996 | Smith | 285/334 |
| 5,505,502 | 4/1996 | Smith et al. | 285/334 |

FOREIGN PATENT DOCUMENTS

| | | | |
|---|---|---|---|
| WO 86/01252 | 2/1986 | WIPO | 285/334 |

*Primary Examiner*—James R. Brittain
*Assistant Examiner*—Gary Grafel
*Attorney, Agent, or Firm*—Browning Bushman

[57] ABSTRACT

An ultra high torque double shoulder tool joint (see FIG. 1) for maximizing the torsional strength of a threaded connection by correlating a transverse cross-sectional counter-bore area of the box (12) and pin (10). The pin 10 includes a base section 74 and a nose section 24. The nose section 24 defines a cross-sectional nose area 28. The pin external threads 22 include a taper no greater than 1/12. The box 12 includes a cross-sectional counterbore area 46 and a cross-sectional box area 52. The overall strength of the tool joint is dependent upon the torsional strength of the threaded connection, the cross-sectional nose area (28) and the cross-sectional counter-bore area (46).

29 Claims, 1 Drawing Sheet

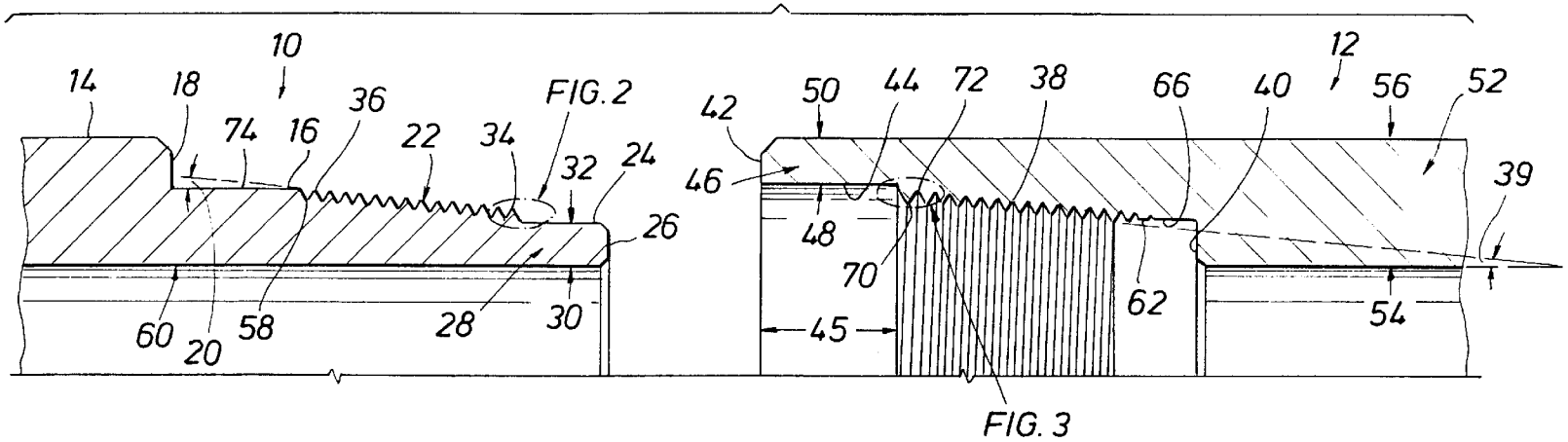
FIG. 1
FIG. 2
FIG. 3
10
12
14
16
18
20
22
24
26
28
30
32
34
36
38
39
40
42
44
45
46
48
50
52
54
56
58
60
62
66
70
72
74
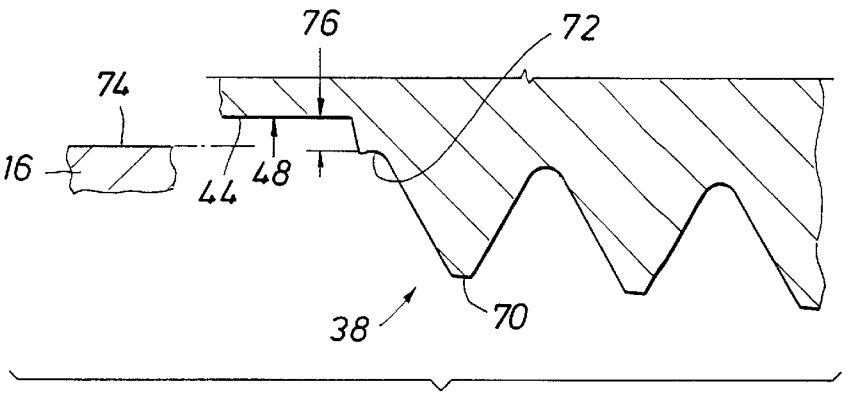
FIG. 3
16
38
44
48
70
72
74
76
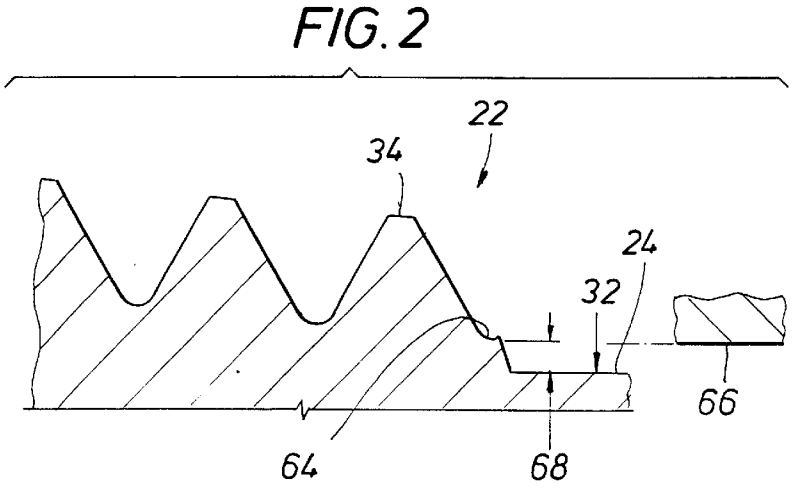
FIG. 2
22
24
32
34
64
66
68

ULTRA HIGH TORQUE DOUBLE SHOULDER TOOL JOINT

FIELD OF THE INVENTION

The present invention relates in general to oilfield tubular threaded connections capable of transmitting torque through the threaded connection during drilling operations. In particular, the present invention relates to oilfield tubular threaded connections on drill pipe, drill collars or tool joints that incorporate tapered threads between a radially outward shoulder and a radially inward shoulder, commonly referred to as a rotary shouldered connection. The double shoulder connection is designed to withstand increased torque and maintain a torsional strength comparable to that of the tubular.

BACKGROUND OF THE INVENTION

Double shoulder threaded connections on oilfield tubulars typically include a pin connector at one end of the tubular and a box connector at the other end. Each connector is adapted to mate with a corresponding connector at the opposite end of another tubular.

The pin connector usually includes a large inside diameter or flow path and external threads extending axially between a radially outward external shoulder and a radially inward pin face. The pin connector also includes a base section extending axially between the external shoulder and the external threads, and a nose section extending axially between the pin face and external threads. The box connector typically includes an inside diameter defining a flow path substantially consistent with that of the pin connector inside diameter, internal threads extending axially between a radially inward internal shoulder and a radially outward box face for threaded connection with the pin connector, and a counterbore section located between the internal threads and the box face.

The external threads and internal threads typically include a taper extending radially outward from a first pin thread adjacent the nose section to a last pin thread adjacent the base section that is sufficiently tapered to allow quick and efficient connection of the pin and box connectors.

In conventional drill pipe, there is usually no internal shoulder in the box member for abutting engagement of a nose or face of the pin. When the pin and box connectors are rotatably connected at the surface, a torque is reached that stresses the pin at the last engaged thread to about one-half its yield strength. If additional torque is imparted during drilling operations, it is possible to exceed the torsional strength of the threads on the pin and box connectors. Consequently, it is advantageous to utilize tool joints with high torque transmission capabilities in order to overcome the weaker threaded connection.

While a number of attempts have been made to create a threaded connection with high torque withstanding abilities, very few have concentrated on the ability to withstand torque in order that the shear stress on the threads is no greater than the strength of the entire tool joint, including the threaded connection. As a result of attempts to withstand—torque in the threaded connection, various design changes have been made to tool joints while attempting to maintain a maximum inside diameter or flow path.

For example, U.S. Pat. No. 4,548,431 to Hall et al presents a tool joint designed to withstand higher torque loading than conventional tool joints. The Hall et al design incorporates a threaded connection having a pin nose section diameter that decreases as the thread length is increased. Thus, since the torsional strength of the Hall et al tool joint is contingent upon the diameter of the pin nose section, increasing the thread length adversely affects the torsional strength. As later determined by testing of the Hall et al design, connections designed with thread lengths adequate for the smallest anticipated inside diameter resulted in a cross-sectional area of the pin nose section at the largest diameter available that was too small. Larger inside diameters produced a pin nose with inadequate strength compared to the pin base, the box counterbore section and the threads. Thus, the threaded connection was not balanced.

U.S. Pat. No. 5,492,375 reveals an improvement over the Hall et al patent. The '375 patent is directed to maximizing the torsional strength of the threaded connection by optimizing the thread length and nose diameter for any given inside diameter. However, neither Hall et al nor the '375 patent strike a geometrically balanced threaded connection without the necessity of correlating the nose diameter or transverse cross-sectional area with the thread length.

Additionally, U.S. Pat. No. 4,549,754 utilizes a thread design that linearly distributes loads along the several threads by decreasing the taper on the external threads relative to the internal threads, such that the taper of the external threads is generally less than the taper of the internal threads.

SUMMARY OF THE INVENTION

The present invention incorporates a novel thread design for downhole tubular connections used in oilfield production and/or completion applications. The threaded connection may consist of a male pin member on one end of a tubular that makes up into a female box member on one end of another tubular, each tubular having a pin member on one end and a box member on the other end. The novel thread design of the present invention utilizes a double-shoulder connection that incorporates a tapered thread between a radially outward external shoulder on the pin member and a radially inward internal shoulder on the box member. The threaded connection is geometrically balanced to withstand torque in the threaded connection after a preload stress has been induced in an area radially adjacent the last pin thread and the radially inward shoulder engages a pin face. Primary consideration is given to the inside diameter or flow path of the tubular for transmission of drilling fluid. Thus, the inside diameter of the threaded connection generally takes precedence over the strength of the connection.

The present invention is directed to maximizing the torsional strength of a threaded connection by correlating a transverse cross-sectional counterbore area of the box and a transverse cross-sectional nose area of the pin. The present invention accomplishes the foregoing objective by use of a tubular pin with external threads extending axially between a radially outward external shoulder and a radially inward pin face. The pin includes a base section extending axially between the external shoulder and external threads, and a nose section extending axially between the pin face and external threads. The nose section defines the cross-sectional nose area between an inside diameter of the nose section and an outside diameter of the nose section. The external threads include a taper substantially less than standard tool joint tapers and preferably includes a taper less than the internal thread taper and no greater than 1 inch per foot extending radially outward from a first pin thread adjacent the nose section to a last pin thread adjacent the base section.

A tubular box is threaded for connection with the pin and has internal threads extending axially between a radially inward internal shoulder and a radially outward box face. The box includes a counterbore section between the internal threads and the box face. The counterbore section defines the cross-sectional counterbore area between an inside diameter of the counterbore section and an outside diameter of the counterbore section. The box defines a cross-sectional box area between an inside diameter of the box and an outside diameter of the box at a location spaced axially opposite the internal threads with respect to the internal shoulder. When the threaded connection is made up, a preload stress is induced in an area radially adjacent the last pin thread when the pin face and internal shoulder are engaged. Additional torque imparted on the threaded connection during make up operations is transmitted through the weaker threaded connection resulting in the planar engagement of the pin face and internal shoulder. As a result, the overall strength of the tool joint is dependent upon the torsional strength of the threaded connection in the area adjacent the engaged pin face and internal shoulder.

The torsional strength of the threaded connection is improved by requiring combined cross-sectional counterbore area and cross-sectional nose area to be at least 70% of the cross-sectional box area. Therefore, a correlation exists between the cross-sectional counterbore area (A1) and cross-sectional nose area (A2) and cross-sectional box area (A3) such that: A1+A2≧(70%) A3. The foregoing correlation may be maintained while also requiring that the counterbore section include an axial length of at least 1.5 inches between the internal threads and the box face. Thus, the torsional strength of the threaded connection is contingent upon A1+A2=(70%) A3 and either the threads include a taper no greater than one inch per foot or the counterbore section has an axial length of at least 1.5 inches.

In one embodiment of the present invention, the cross-sectional counterbore area is at least 10% greater than a cross-sectional area between a root of the last pin thread and an inside diameter of the pin radially adjacent thereto, and the internal threads and external threads have an axial spacing of about 3.5 threads per inch. Additionally, the inside diameter of the nose section is no less than the inside diameter of the box at a location spaced axially opposite the internal threads with respect to the internal shoulder, and the outside diameter of the box is no greater than an outside diameter of the box between the box face and the internal shoulder.

In another embodiment of the present invention, an outside diameter of the base section and inside diameter of the counterbore section define a radial clearance of at least 0.03 inches when the pin and box are connected. The outside diameter of the nose section and an inside diameter of the box radially adjacent the nose section define a radial clearance of at least 0.03 inches when the pin and box are connected as well.

According to a preferred method for forming the threaded connection of the present invention, a pin is formed with external threads extending axially between a radially outward external shoulder and a radially inward pin face. The pin includes a base section extending axially between the external shoulder and the external threads, and a nose section extending axially between the pin face and external threads. The nose section also defines a cross-sectional nose area between an inside diameter of the nose section and an outside diameter of the nose section. The external threads include the taper no greater than one inch per foot extending radially outward from the first pin thread adjacent the nose section to a last pin thread adjacent the base section.

A tubular box is formed for threaded connection with the pin and has internal threads extending axially between a radially inward internal shoulder and a radially outward box face. The box includes a counterbore section between the internal threads and the box face. The counterbore section defines a cross-sectional counterbore area between an inside diameter of the counterbore section and an outside diameter of the counterbore section. The box defines a cross-sectional box area at a location spaced axially opposite the internal threads with respect to the internal shoulder in-between an inside diameter of the box and an outside diameter of the box. The cross-sectional counterbore area and cross-sectional nose area define a combined cross-sectional area of at least 70% of the cross-sectional box area. The pin and box are then connected to engage the box face with the external shoulder and induce a preload stress on both the pin and the box in an area radially adjacent the last pin thread. Finally, torque is transmitted through the planar engagement of the pin face and internal shoulder during drilling operations such that the threaded connection possesses a torsional strength comparable to that of the tubular.

It is therefore a general object of the present invention to provide an improved double shoulder threaded connection that is capable of withstanding torque in the threaded connection and possesses a torsional strength comparable to that of the tubular.

It is therefore an object of the present invention to provide a double shoulder threaded connection having a combined cross-sectional counterbore area and cross-sectional nose area of at least 70% of the cross-sectional box area.

It is yet another object of the present invention to provide an improved double shoulder threaded connection with internal threads and external threads that have an axial spacing sufficient to secure the pin and box members when placed in tension and facilitate the transmission of torque through the threads into the internal shoulder.

It is yet another object of the present invention to provide a double shoulder threaded connection with balanced geometries such that:

1. A1+A2≧(70%) A3; and
2. the external thread taper is no greater than one inch per foot; or
3. the counterbore section axial length is at least 1.5 inches.

It is a feature of the present invention to provide a double shoulder threaded connection with external threads having a taper no greater than about one inch per foot extending radially outward from a first pin thread adjacent the nose section to a last pin thread adjacent the base section.

Still another feature of the present invention is to provide a double shoulder threaded connection including a counterbore section having an axial length of at least 1.5 inches between the internal threads and the box face.

It is an advantage of the present invention to provide a threaded connection with a sufficient taper to enable quick and efficient connection of the threaded pin and box members.

It is yet another advantage of the present invention to provide a larger cross-sectional nose width.

It is yet another advantage of the present invention to provide a double shoulder threaded connection with a radial clearance of at least 0.03 inches between the outside diameter of the base section and an inside diameter of the counterbore section when the pin and box are connected.

It is yet another advantage of the present invention to provide a double shoulder threaded connection with a radial clearance of at least 0.03 inches between the outside diameter of the nose section and an inside diameter of the box radially adjacent the nose section when the pin and box are connected.

It is yet another advantage of the present invention to provide a double-shoulder threaded connection with an external thread taper that is less than the internal thread taper.

These and further objects, features, and advantages of the present invention will become apparent from the following detailed description, wherein reference is made to the figures and in the accompanying drawings.

BRIEF DESCRIPTION OF THE DRAWINGS

FIG. 1 is a longitudinal quarter sectional view of pin and box members according to the present invention in position for threaded connection.

FIG. 2 is an enlarged detail view of the area encircled in FIG. 1.

FIG. 3 is an enlarged detail view of the area encircled in FIG. 1.

DETAILED DESCRIPTION OF PREFERRED EMBODIMENTS

With reference now to FIG. 1, a tubular threaded pin 10 is located at one end of a section of drill pipe in position for mating connection to a tubular threaded box 12 of another section of drill pipe. The pipe carrying the pin 10 has a corresponding box similar to 12 at its other end. Likewise, the pipe carrying the box 12 has a pin similar to 10 at its other end.

The tubular pin 10 includes external threads 22 extending axially between a radially outward external shoulder 18 and a radially inward pin face 26. The pin 10 also includes a base section 16 extending axially between the external shoulder 18 and the external threads 22, and a nose section 24 extending axially between the pin face 26 and external threads 22. The nose section 24 further defines a cross-sectional nose area 28 between an inside diameter 30 of the nose section 24 and an outside diameter 32 of the nose section 24.

The cross-sectional nose area 28 is material to the torsional strength of the threaded connection. The cross-sectional nose area 28 is a function of the axial length and taper of the threads. Fewer threads per inch and a shallow taper result in a higher torsional strength of the overall threaded connection. Conversely, a steeper taper permits quick connection of the tubular pipe sections. More threads per inch reduces slippage or disconnection of the pipe sections under tension loads. Consequently, a number of geometrical dimensions must be balanced to achieve a threaded connection capable of high torque transmission through the threaded connection.

The present invention reduces the standard thread taper on tubulars of 1¼ to 2 inches to no greater than 1 inch per foot. The external threads 22 therefore include a taper that extends radially outward from a first pin thread 34 adjacent the nose section 24 to a last pin thread 36 adjacent the base section 16. The external threads 22 have a taper that is no greater than about 1 inch per foot extending radially outward from the first pin thread 34 to the last pin thread 36, and is preferably no larger than 0.8 inches per foot.

The tubular box 12 is threaded for connection with the pin 10 and includes internal threads 38 extending axially between a radially inward internal shoulder 40 and a radially outward box face 42. Although the internal threads 38 preferably include a taper greater than the taper of the external threads 22 for linear distribution of loading across the external threads 22 and internal threads 38 when the pin 10 and box 12 are connected, the internal threads 38 and external threads 22 may include an identical taper. Thus, the internal threads 38 include a taper that forms an angle 39 of approximately 1.8 degrees relative to an axis of the box 12 that is greater than the taper of the external threads 22 that form an angle 20 of approximately 1.6 degrees relative to an axis of the pin 10.

There are approximately 3.5 external threads 22 per inch in a preferred embodiment to reduce slippage of the threaded connection when placed under tension. The box 12 includes a counterbore section 44 having an axial length 45 greater than about 1.5 inches, and preferably at least 2 inches, located between the internal threads 38 and the box face 42. The axial length 45 of the counterbore section 44 must be large enough to increase the mass or volume of material over which the torque or stress is distributed in order to not exceed the stress limits of the tubular connection. The counter bore section 44 defines a cross-sectional counterbore area 46 between an inside diameter 48 of the counterbore section 44 and an outside diameter 50 of the counterbore section 44. The box 12 also defines a cross-sectional box area 52 between an inside diameter 54 of the box 12 and an outside diameter 56 of the box 12 at a location spaced axially opposite the internal threads 38 with respect to the internal shoulder 40.

In a preferred embodiment, the cross-sectional counterbore area 46 is at least 10% greater than a cross-sectional area between a root of the last pin thread 58 and an inside diameter 60 of the pin 10 radially adjacent thereto. It is important to maintain comparable torsional strength between the cross-sectional counterbore area 46 and the cross-sectional area between a root of the last pin thread 58 and the inside diameter 60 of the pin 10 radially adjacent thereto. Thus, in order to maintain a comparable torsional strength and prevent fatigue of the tubular in the area thus described, it is preferable to maintain a comparable cross-sectional counterbore area 46 with that of the cross-sectional area between a root of the last pin thread 58 and an inside diameter 60 of the pin 10 radially adjacent thereto. The cross-sectional counterbore area 46 is preferably 10% greater than the cross-sectional area between a root of the last pin thread 58 and an inside diameter 60 of the pin 10 radially adjacent thereto in order to account for material reduction caused by wear and friction to the outside diameter 50 of the counterbore section 44.

When the pin 10 and box 12 are connected prior to use, the box face 42 and external shoulder 18 are placed in mating planar engagement. During make up operations, an axial preload stress is placed on both the pin 10 and the box 12 in an area radially adjacent the last pin thread 36 when the pin face 26 and internal shoulder 40 are engaged. The pin face 26 and internal shoulder 40 preferably form an axial clearance of at least 0.005 inches when the box face 42 and external shoulder 18 are initially engaged for inducing a preload stress to both the pin 10 and box 12 in an area radially adjacent the last pin thread 36 prior to mating planar engagement of the pin face 26 and internal shoulder 40. The dimensions of the threaded connection thus described enable the transmission of torque encountered during drilling operations through the threaded connection until the pin face 26 and internal shoulder 40 are engaged. The additional torque encountered in the engaged pin face 26 and internal shoulder 40 is concentrated adjacent the last engaged thread 62 on the internal threads 38 of the box 12. Thus, the axial compressive loads encountered in the area radially adjacent the last box thread 62 on the internal threads 38 require that the combined cross-sectional counterbore area 46 and cross-sectional nose area 28 be at least 70% of the cross-sectional box area 52, and preferably at least about 75% of the cross-sectional box area 52.

Although the combined torsional strength of the cross-sectional nose area 28 and cross-sectional counterbore area 46 may be manipulated by increasing the outside diameter of the counterbore section 50 or decreasing the internal diameter of the nose section 30, considerable deference is given to the flow path or inside diameter of the threaded connection over its yield strength. Consequently, the present invention allows for an optimal flow path and maximum inside diameter for the pin 10 and box 12 by correlating specific geometries of the pin 10 and box 12 as explained herein above.

In a preferred embodiment, the inside diameter 30 of the nose section 24 is no less than the inside diameter 54 of the box 12, and the outside diameter 56 of the box 12 is no greater than an outside diameter 50 of the box 12 between the box face 42 and the internal shoulder 40.

Referring now to FIG. 2, the external threads 22 are shown in an enlarged detail view of the area encircled in FIG. 1. In a preferred embodiment, the first pin thread 34 includes a root 64 having an outside diameter greater than the nose section 24 outside diameter 32. Additionally, the outside diameter 32 of the nose section 24 and an inside diameter 66 of the box 12 radially adjacent the nose section defines a radial clearance 68 of at least 0.03 inches when the pin 10 and box 12 are connected.

Referring now to FIG. 3, an enlarged detail view of the internal threads 38 of the area encircled in FIG. 1 are shown. In a preferred embodiment, the box 12 has a first box thread 70 adjacent the counterbore section 44. The counterbore section inside diameter 48 is preferably greater than an inside diameter of a root 72 of the first box thread 70. Additionally, an outside diameter 74 of the base section 16 and inside diameter 48 of the counterbore section 44 define a radial clearance 76 of at least 0.03 inches when the pin 10 and box 12 are connected.

In a preferred embodiment for forming a threaded connection in accordance with the present invention, a tubular pin 10 is formed with external threads 22 extending axially between a radially outward external shoulder 18 and a radially inward pin face 26 as shown in FIG. 1. The pin 10 includes a base section 16 extending axially between the external shoulder 18 and the external threads 22, and a nose section 24 extending axially between the pin face 26 and external threads 22. The nose section 24 defines a cross-sectional nose area 28 between an inside diameter 30 and an outside diameter 32 of the nose section 24. The external threads 22 also have a taper no greater than about 1 inch per foot, and preferably no greater than about 0.8 inches per foot, extending radially outward from a first pin thread 34 adjacent the nose section 24 to a last pin thread 36 adjacent the base section 16.

A tubular box is formed for threaded connection with the pin 10. The tubular box 12 has internal threads 38 extending axially between a radially inward internal should 40 and a radially outward box face 42. Although the internal threads 38 preferably include a taper greater than the taper of the external threads 22 for linear distribution of loading across the external threads 22 and internal threads 38 when the pin 10 and box 12 are connected, the internal threads 38 and external threads 22 may include an identical taper. Thus, the internal threads 38 include a taper that forms an angle 39 of approximately 1.8 degrees relative to an axis of the box 12 that is greater than the taper of the external threads 22 that form an angle 20 of approximately 1.6 degrees relative to an axis of the pin 10.

The tubular box 12 also includes a counterbore section 44 between the internal threads 38 and the box face 42. The counterbore section 44 defines a cross-sectional counterbore area 46 between an inside diameter 48 and an outside diameter 50 of the counterbore section 44. Furthermore, the box 12 defines a cross-sectional box area 52 between an inside diameter 54 and an outside diameter 56 of the box 12 at a location spaced axially opposite the internal threads 38 with respect to the internal shoulder 40.

The box 12 and pin 10 are then connected to engage the box face 42 with the external shoulder 18. During make up operations, an axial preload stress is placed on both the pin 10 and box 12 in an area radially adjacent the last pin thread 36 when the pin face 26 and internal shoulder 40 are engaged. Once the torque is transmitted through the threaded connection, the overall torsional strength of the pin 10 and box 12 is uniformly maintained, provided that the combined cross-sectional counterbore area 46 and cross-sectional nose area 28 are at least 70%, and preferably at least 75%, of the cross-sectional box area 52.

Various additional modifications to the threaded connection described herein should be apparent from the above description of the preferred embodiments. Although the invention has thus been described in detail for these embodiments, it should be understood that this explanation is for illustration only and that the invention is not committed to the described embodiments. Alternative components and operating techniques should be apparent to those skilled in the art in view of this disclosure. Modifications were thus contemplated and may be made without departing from the spirit of the invention, which is defined by the claims.

What is claimed is:

1. An oilfield tubular threaded connection with high torque transmission capability through the threaded connection comprising:

a tubular pin with external threads extending axially between a radially outward external shoulder and a radially inward pin face, the pin including a base section extending axially between the external shoulder and the external threads and a nose section extending axially between the pin face and external threads, said nose section defining a cross-sectional nose area between an inside diameter of said nose section and an outside diameter of said nose section;

said external threads having a taper no greater than 1 inch per foot extending radially outward from a first pin thread adjacent said nose section to a last pin thread adjacent said base section;

a tubular box for threaded connection with said pin, said tubular box having internal threads extending axially between a radially inward internal shoulder and a radially outward box face and including a counter-bore section between the internal threads and said box face, said counter-bore section defining a cross-sectional counter-bore area between an inside diameter of said counter-bore section and an outside diameter of said counter-bore section, and said box defining a cross-sectional box area between an inside diameter of said box and an outside diameter of said box at a location spaced axially opposite the internal threads with respect to the internal shoulder;

said cross-sectional counter-bore area and said cross-sectional nose area defining a combined cross-sectional area of at least 70% of said cross-sectional box area; and said box face and said external shoulder being in mating planar engagement when said pin and said box are made up for inducing a pre-load stress on both said pin and said box in an area radially adjacent said last pin thread prior to mating planar engagement of said pin face and said internal shoulder.

2. The threaded connection as defined in claim 1, wherein said combined cross-sectional area is at least 75% of said cross-sectional box area.

3. The threaded connection as defined in claim 1, wherein said taper is no greater than about 0.8 inches per foot extending radially outward from said first pin thread to said last pin thread.

4. The threaded connection as defined in claim 1, wherein said internal threads include a taper that is greater than the taper of the external threads.

5. The threaded connection as defined in claim 1, wherein said cross-sectional counter-bore area is greater than a cross-sectional area between a root of the last pin thread and an inside diameter of said pin radially adjacent thereto.

6. The threaded connection as defined in claim 5, wherein said cross-sectional counter-bore area is at least 10% greater than the cross-sectional area between the root of the last pin thread and the inside diameter of said pin radially adjacent thereto.

7. The threaded connection as defined in claim 1, wherein said internal threads and said external threads have an axial spacing of less than about 4 threads per inch.

8. The threaded connection as defined in claim 7, wherein said axial spacing is about 3.5 threads per inch.

9. The threaded connection as defined in claim 1, wherein said box has a first box thread adjacent said counter-bore section and a last box thread adjacent said internal shoulder, said counter-bore section inside diameter being greater than an inside diameter of a root of the first box thread.

10. The threaded connection as defined in claim 1, wherein a root on the first pin thread has an outside diameter greater than an outside diameter of said nose section.

11. The threaded connection as defined in claim 1, wherein the inside diameter of said nose section is no less than the inside diameter of said box.

12. An oilfield tubular threaded connection with high torque transmission capability through the threaded connection comprising:

a tubular pin with external tapered threads extending axially between a radially outward external shoulder and a radially inward pin face, the pin including a base section extending axially between the external shoulder and the external threads and a nose section extending axially between the pin face and external threads, said nose section defining a cross-sectional nose area between an inside diameter of said nose section and an outside diameter of said nose section;

a tubular box for threaded connection with said pin, said tubular box having internal threads extending axially between a radially inward internal shoulder and a radially outward box face and including a counter-bore section having an axial length of at least 1.5 inches between the internal threads and said box face, said counter-bore section defining a cross-sectional counter-bore area between an inside diameter of said counter-bore section and an outside diameter of said counter-bore section, and said box defining a cross-sectional box area between an inside diameter of said box and an outside diameter of said box at a location spaced axially opposite the internal threads with respect to the internal shoulder;

said outside diameter of said nose section and an inside diameter of said box radially adjacent said nose section defining a radial clearance there between when said pin and said box are connected;

said cross-sectional counter-bore area and said cross-sectional nose area defining a combined cross-sectional area of at least 70% of said cross-sectional box area; and said pin face and said internal shoulder of said box having an axial clearance of at least 0.005 inches when said pin and said box are initially made up for inducing a pre-load steps to both of said pin and said box in an area radially adjacent a last pin thread prior to mating planar engagement of said pin face and said internal shoulder.

13. The threaded connection as defined in claim 12, wherein the axial length of said counter-bore section is greater than about 2 inches.

14. The threaded connection as defined in claim 12, wherein said combined cross-sectional area is at least 75% of said cross-sectional box area.

15. The threaded connection as defined in claim 12, wherein said cross-sectional counter-bore area is greater than a cross-sectional area between a root of the last pin thread and an inside diameter of said pin radially adjacent thereto.

16. The threaded connection as defined in claim 12, wherein an outside diameter of said base section and said inside diameter of said counter-bore section define a radial clearance of at least 0.03 inches when said pin and said box are connected.

17. The threaded connection as defined in claim 12, wherein said outside diameter of said box is no greater than an outside diameter of said box between said box face and said internal shoulder.

18. The threaded connection as defined in claim 12, wherein said internal threads include a taper that is greater than a taper of the external threads.

19. A method for forming a threaded connection in an oilfield tubular with high torque transmission capability through the threaded connection comprising:

forming a tubular pin with external threads extending axially between a radially outward external shoulder and a radially inward pin face, the pin including a base section extending axially between the external shoulder and the external threads and a nose section extending axially between the pin face and external threads, said nose section defining a cross-sectional nose area between an inside diameter of said nose section and an outside diameter of said nose section;

said external threads having a taper no greater than 1 inch per foot extending radially outward from a first pin thread adjacent said nose section to a last pin thread adjacent said base section;

forming a tubular box for threaded connection with said pin, said tubular box having internal threads extending axially between a radially inward internal shoulder and a radially outward box face and including a counter-bore section between the internal threads and said box face, said counter-bore section defining a cross-sectional counter-bore area between an inside diameter of said counter-bore section and an outside diameter of said counter-bore section, and said box defining a cross-sectional box area at a location spaced axially opposite the internal threads with respect to the internal shoulder and between an inside diameter of said box and an outside diameter of said box;

said cross-sectional counter-bore area and said cross-sectional nose area defining a combined cross-sectional area of at least 70% of said cross-sectional box area;

connecting said box and said pin to engage said box face with said external shoulder and induce a pre-load stress on both said pin and said box in an area radially adjacent said last pin thread; and transmitting torque through the planar engagement of said pin face and said internal shoulder during drilling operations.

20. An oilfield tubular threaded connection with high torque transmission capability through the threaded connection comprising:

a tubular pin with external threads extending axially between a radially outward external shoulder and radially inward pin face, the pin including a base section extending axially between the external shoulder and the external threads, and a nose section extending axially between the pin face and external threads, said nose section defining a cross-sectional nose area between an inside diameter of said nose section and an outside diameter of said nose section;

said external threads having a taper no greater than one inch per foot extending radially outward from a first pin thread adjacent said nose section to a last pin thread adjacent said base section;

a tubular box for threaded connection with said pin, said tubular box having internal threads which include a taper that is greater than the taper of the external threads, the internal threads extending axially between a radially inward internal shoulder and a radially outward box face and including a counterbore section between the internal threads and said box face, said counterbore section defining a cross-sectional counter-bore area between an inside diameter of said counter-bore section and an outside diameter of said counter-bore section, and said box defining a cross-sectional box area between an inside diameter of said box and an outside diameter of said box at a location spaced axially opposite the internal threads with respect to the internal shoulder;

said cross-sectional counterbore area and said cross-sectional nose area defining a combined cross-sectional area of at least 70% of said cross-sectional box; and said box face and said external shoulder being in mating planar engagement when said pin and said box are made up for inducing a preload stress on both said pin and said box in an area radially adjacent said last pin thread prior to mating planar engagement of said pin face and said internal shoulder.

21. The threaded connection as defined in claim 20, wherein said combined cross-sectional area is at least 75% of said cross-sectional box area.

22. The threaded connection as defined in claim 20, wherein said taper is no greater than about 0.8 inches per foot extending radially outward from said first pin thread to said last pin thread.

23. The threaded connection as defined in claim 20, wherein said cross-sectional counter-bore area is greater than a cross-sectional area between a root of the last pin thread and an inside diameter of said pin radially adjacent thereto.

24. The threaded connection as defined in claim 23, wherein said cross-sectional counter-bore area is at least 10% greater than the cross-sectional area between the root of the last pin thread and the inside diameter of said pin radially adjacent thereto.

25. The threaded connection as defined in claim 20, wherein said internal threads and said external threads have an axial spacing of less than about 4 threads per inch.

26. The threaded connection as defined in claim 25, wherein said axial spacing is about 3.5 threads per inch.

27. The threaded connection as defined in claim 20, wherein said box has a first box thread adjacent said counter-bore section and a last box thread adjacent said internal shoulder, said counter-bore section inside diameter being greater than an inside diameter of a root of the first box thread.

28. The threaded connection as defined in claim 20, wherein a root on the first pin thread has an outside diameter greater than an outside diameter of said nose section.

29. The threaded connection as defined in claim 20, wherein the inside diameter of said nose section is no less than the inside diameter of said box.

* * * * *